US005156524A

United States Patent [19]

Forni

[11] Patent Number: 5,156,524

[45] Date of Patent: Oct. 20, 1992

[54] CENTRIFUGAL FAN WITH ACCUMULATING VOLUTE

[75] Inventor: Ronald J. Forni, Lexington, Mass.

[73] Assignee: Airflow Research and Manufacturing Corporation, Watertown, Mass.

[21] Appl. No.: 604,747

[22] Filed: Oct. 26, 1990

[51] Int. Cl.[5] ..... F04D 29/42

[52] U.S. Cl. ..... 415/182.1; 415/206

[58] Field of Search ..... 415/182.1, 206, 203, 415/204, 205

[56] References Cited

U.S. PATENT DOCUMENTS

| | | | |
|---|---|---|---|
| 3,301,472 | 1/1967 | Dixon et al. | 415/206 |
| 3,407,995 | 10/1968 | Kinsworthy | 415/206 |
| 4,448,573 | 5/1984 | Franz | 415/206 |
| 4,919,592 | 4/1990 | Sears et al. | 415/207 |

FOREIGN PATENT DOCUMENTS

| | | | |
|---|---|---|---|
| 145497 | 7/1985 | Japan | 415/206 |
| 2057567 | 4/1981 | United Kingdom | 415/206 |

OTHER PUBLICATIONS

WO90/09524 Aug. 1990 Martin.

*Primary Examiner*—John T. Kwon

[57] ABSTRACT

Centrifugal blowers which maintain a substantially constant (usually ±5%) static pressure field around the circumference of the blower's impeller, notwithstanding at least one abrupt radial or axial discontinuity in the volute of the blower, e.g., due to one or more external axial and/or radial constraints in an irregularly shaped package. The blower accommodates such constraints by including discontinuities in the volute; therefore the blower takes advantage of relatively unconstrained segments of the package to have an overall large size. Notwithstanding the volute discontinuities, a substantially constant pressure field around the impeller is achieved by maintaining a specific relationship between G(Θ) and H(Θ), G(Θ) being radial extent of the volute as a function of the angular displacement Θ around the impeller's circumference and H(Θ) being the axial extent of the volute as a function of Θ, angular displacement around the volute.

13 Claims, 5 Drawing Sheets

CENTRIFUGAL FAN WITH ACCUMULATING VOLUTE

BACKGROUND OF THE INVENTION

This invention relates to the housing (volute) surrounding a centrifugal blower or fan.

Centrifugal blowers and fans generally include an impeller that rotates in a predetermined direction in a housing and is driven by a motor. Such blowers are used in a variety of applications where energy consumption, efficiency, noise, and space constraints are important. Various prior housing designs have attempted to meet predetermined space constraints while maintaining the desired performance.

Generally, a volute may be included around the circumference of a centrifugal fan to accumulate the flow generated by the impeller, particularly for fans with backward curved impeller blades. Volutes add substantially to the overall blower package size, forcing a tradeoff of increased efficiency from the volute aerodynamics, on the one hand, versus reduced motor and impeller size, resulting in increased energy consumption and noise on the other.

Japanese patent (#52-86554) describes a housing or volute which expands with angle in the axial direction.

U.S. Pat. No. 3,246,834 describes a housing which expands significantly in the axial direction.

In many instances, the blower must be accommodated in a space that includes significant discontinuities, e.g. due to packaging constraints from other equipment. Specifically, for automobile blowers positioned in tightly configured spaces, such discontinuities are common.

SUMMARY OF THE INVENTION

The invention features centrifugal blowers which a substantially constant (usually ±5%) static pressure field around the circumference of the blower's impeller, notwithstanding at least one abrupt radial or axial discontinuity in the volute of the blower. An abrupt discontinuity is generally characterized by at least a 5% change in the first derivative of the function in question ($G(\Theta)$ or $H(\Theta)$ as defined below) over an angular change of 30° or less. The design according to the invention is particularly useful for blowers installed in irregularly shaped packages, where a regularly shaped blower would be considerably smaller due to one or more external axial and/or radial constraints.

According to the invention, the blower accommodates such constraints by including discontinuities in the volute; therefore the blower takes advantage of relatively unconstrained segments of the package to have an overall large size. Notwithstanding the volute discontinuities, a substantially constant pressure field around the impeller is achieved by maintaining a specific relationship described below between $G(\Theta)$ and $H(\Theta)$, $G(\Theta)$ being radial extent of the volute as a function of the angular displacement $\Theta$ around the impeller's circumference as shown in FIG. 2, and $H(\Theta)$ being the axial extent of the volute as a function of $\Theta$. By maintaining the relationships $G(\Theta)$ and $H(\Theta)$ described below, the invention avoids the undesirable alternatives in which: a) the volute is smooth, but must be relatively small as dictated by the most restrictive point in the flow path; or b) flow separation (with resulting inefficiency) occurs due to an extreme discontinuity.

The goal of a uniform pressure field around the impeller circumference can be analyzed in terms of conservation of angular momentum around the impeller. As long as the viscous forces are small, they cannot have a significant impact on the angular momentum of the fluid in the short time it is contained within the volute. If the impeller sees a uniform pressure field around its circumference, there is no pressure gradient in the tangential direction which would cause a change in the fluid's angular momentum.

On the above assumption—i.e., that the fluid's angular momentum is conserved about the axis of rotation—the cross-sectional shape of the volute at a given angle is designed as follows. First, the assumption that angular momentum is conserved about the axis leads to the conclusion that the tangential velocity of the fluid is proportional to 1/radius. The volute is designed to accumulate the tangential velocity, placing a constraint on the two functions $G(\Theta)$ and $H(\Theta)$—i.e., the functions are not independent, and they are related as follows:

$$G(\Theta)=g_o\,(e^{h.\tan\alpha/H(\Theta)}-1),$$

where $g_o$ is a constant, h is the axial dimension of the volute at the volute origin; and $\alpha$ is the average angle of airflow exiting the impeller.

Thus, in one aspect, the invention generally features a centrifugal blower in which $G(\Theta)$, $H(\Theta)$, or both, is characterized by an abrupt discontinuity, and the volute has a cross-sectional area which maintains a substantially constant pressure field around the impeller at the design point for the blower, e.g. when the blower is producing an airflow at the volute exit which is within a pre-designed range.

Another aspect of the invention generally features a centrifugal blower in which $G(\Theta)$, $H(\Theta)$, or both, is characterized by an abrupt discontinuity, and the functions $G(\Theta)$ and $H(\Theta)$ are related as specified above.

We have also discovered that such volutes can be designed to accumulate a significant portion of the flow rate in a space (a subvolute) axially offset from the impeller and characterized by an inner radius which is less the outer radius of the impeller. This subvolute region preferably extends over most (preferably at least 90°) of the blower's circumference and accommodates a significant portion (at least 20%) of the volumetric flow in the volute. For example, the subvolute region extends from $\Theta \leqq 30°$ to the volute exit. The inner radius of the subvolute is less than 90% of the impeller radius over at least 45° of the blower circumference. Such designs are particularly appropriate for axially extended volutes (e.g. the axial extent of the volute is at least twice the axial extent of the impeller over at least 15° of the blower's circumference). Also preferably, the discontinuous function is a Fermi function, or a superposition of multiple Fermi functions.

The invention thus provides improved performance by purposely introducing a discontinuity to accommodate an axial or radial restriction that would so substantially limit the cross-sectional area of a "smooth" volute—e.g. a volute whose cross-sectional area expands linearly with increasing angle. Such a "smooth" volute would exhibit substantially poorer performance, e.g., in terms of power consumption for a given impeller and flow rate or in terms of noise for a given flow rate and a smaller impeller.

Thus, the invention recognizes that "smoothness" in the volute may be sacrificed to accommodate a tortuous package constraint, to yield a larger volute and, overall, a more efficient volute design.

Other features and advantages of the invention will be apparent from the following description of the preferred embodiment.

DESCRIPTION OF THE PREFERRED EMBODIMENT

STRUCTURE

Figure 1A:
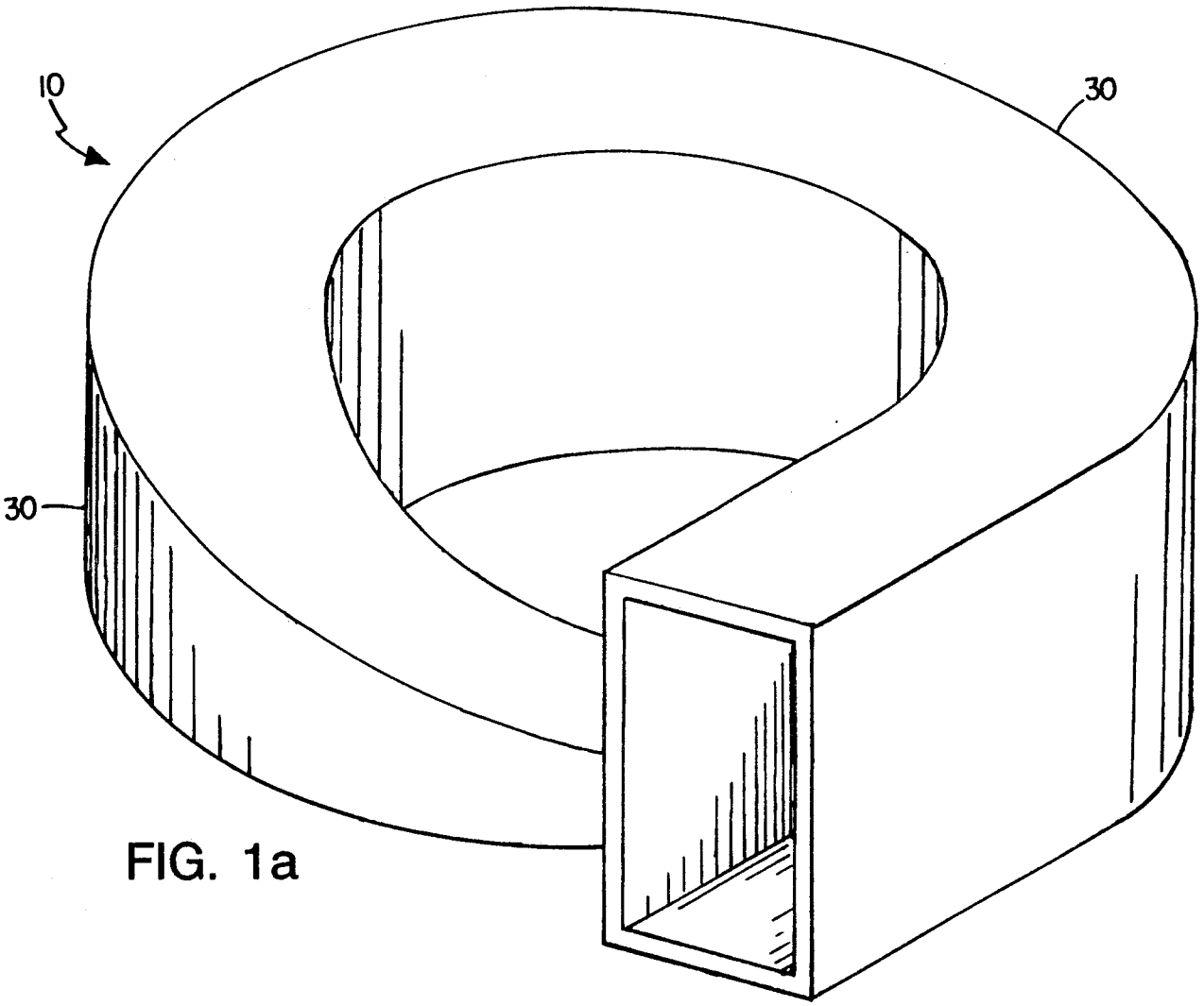
FIG. 1A is a highly diagrammatic representation of a centrifugal blower and volute according to the invention.
Figure 1B:
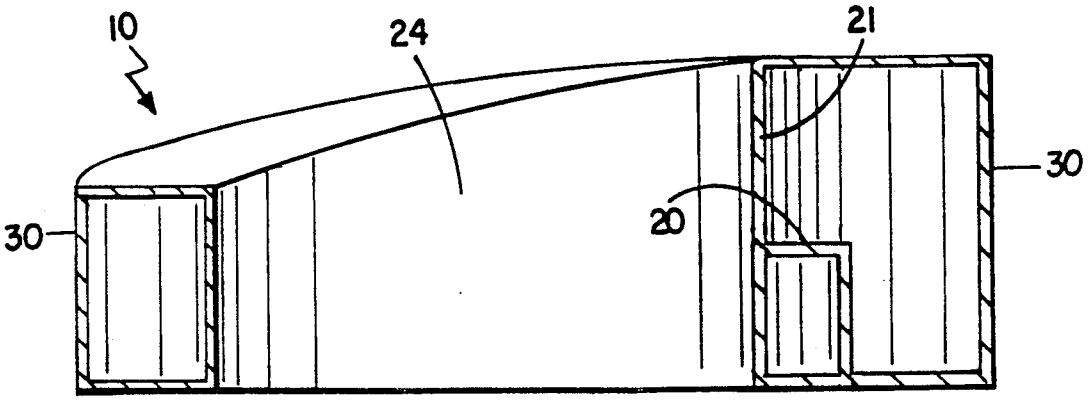
FIG. 1B is a view, partially in section, taken along 1B—1B of FIG. 2.

In FIGS. 1A and 1B, blower 10 includes an impeller impeller having conventional blades (not shown) driven by a motor (not shown) to draw air axially into the impeller inlet 24. The blades expel air radially into volute 30 which surrounds the impeller. Volute 30 encounters certain axial and/or radial constraints, illustrated in other figures. FIG. 1B is a sectional view, partly broken away, along 1B—1B of FIG. 2. The circumference of the impeller is indicated by two lines, 20 and 21, representing the inlet side and the motor side of the impeller respectively.

Figure 2:
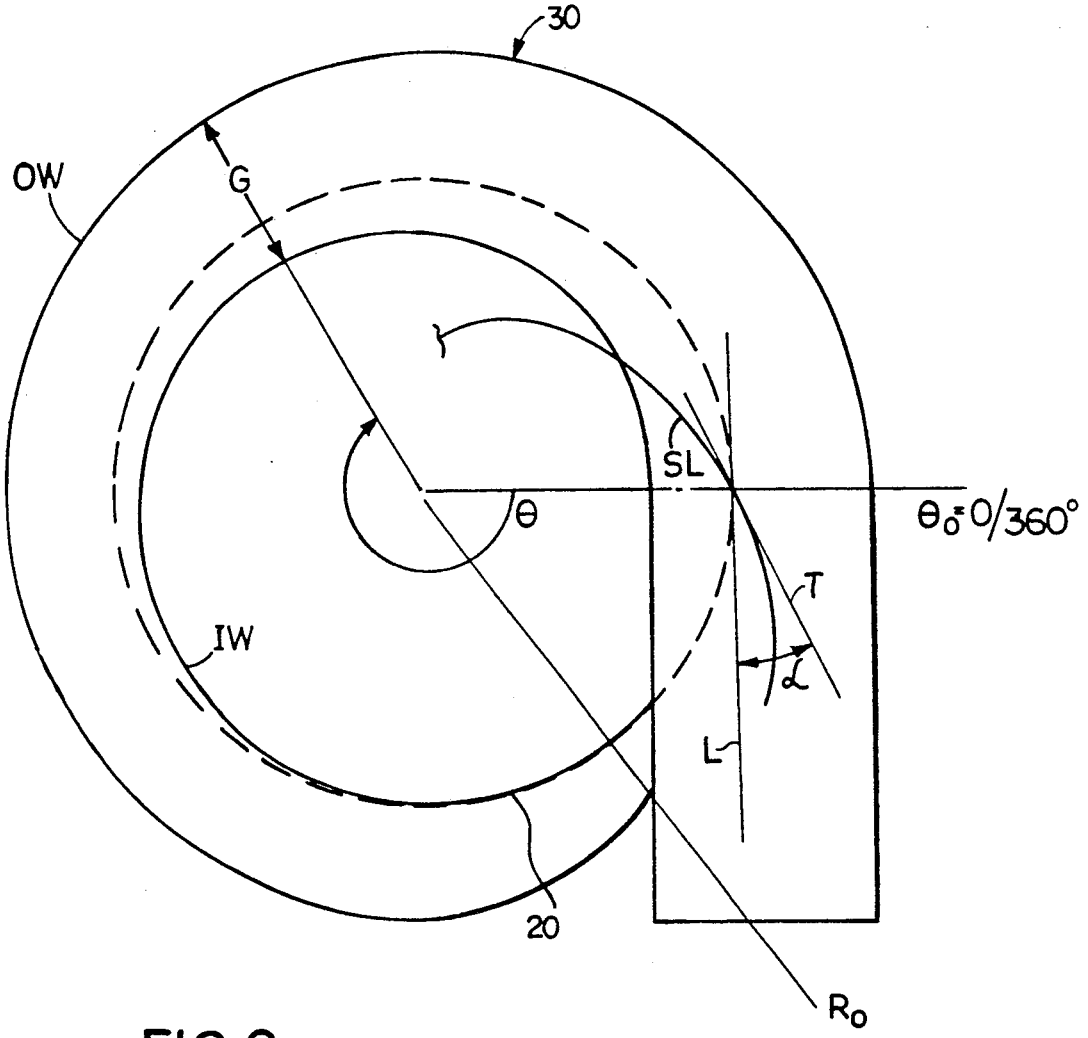
FIG. 2 is a cross section through the axis of a generalized volute defining variables.

FIG. 2 is a graph based on a section perpendicular to the axis of a generalized blower. FIG. 2 has been generalized to show variables discussed below, and FIG. 2 is not necessary drawn to scale. In FIG. 2, the outer wall of volute 30 is labeled OW and the inner wall of volute 30 is labeled IW. Specifically, FIG. 2 shows G, the volute's radial dimension, as a function of Θ, the angular displacement from $\Theta_o$, the volute exit plane. In the equation given above relating G(Θ) and H(Θ), "h" is the axial dimension of the volute at $R_o$. H and h are shown in FIG. 1. α is an angle formed between a tangent T to the airflow streamline SL and a line L perpendicular to the radius at that tangent. α will be characteristic of a given impeller, primarily as a function of the blade angle (forward versus rearward sweep). Circles 20 representing the circumference of the impeller, is shown by a broken line in the region over which the inner radius of volute 30 is less than the outer radius of the impeller.

Those skilled in the art will recognize that blowers according to the invention can be produced using computer assisted design and machinery, so that the requisite relationships have been satisfied. Angle α can be measured, e.g. with Pitot tubes. One useful approach for such a design is the structuring of H(Θ) in terms of a Fermi function illustrated in the following example.

The constant, $g_o$, described above is determined by boundary conditions. Specifically, the flux leaving the volute must equal the flux leaving the blower at the design conditions (e.g. the design point for airflow).

Figure 3:
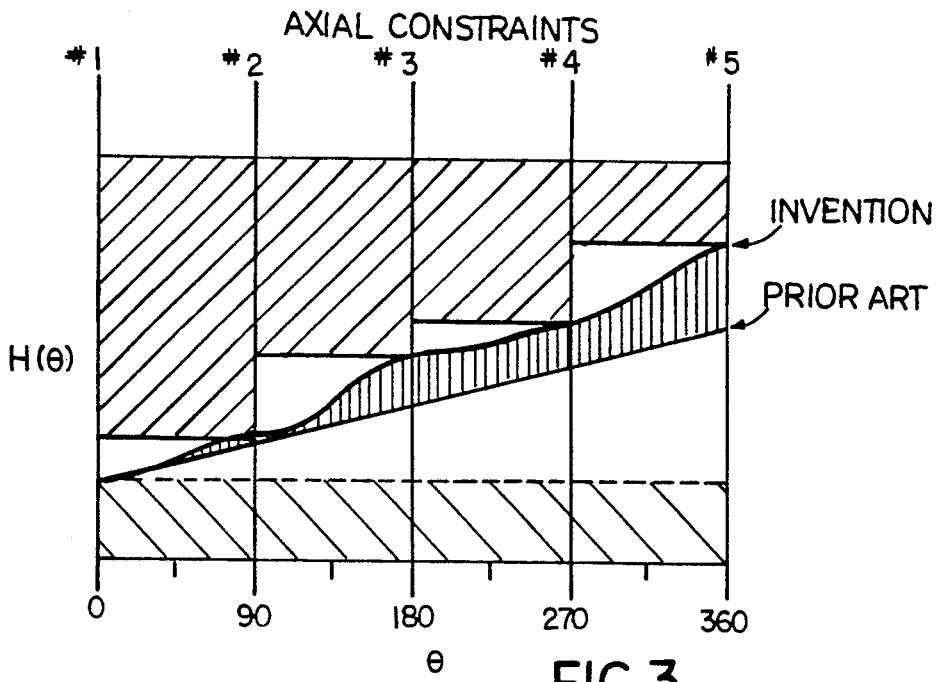
FIG. 3 is a graph showing two volute designs (linear and discontinuous) meeting same axial package constraints 1-5.

FIG. 3 shows the axial dimension of a blower designed in accordance with the invention to meet certain axial packaging constraints. The ordinate in FIG. 1 is the angular position around the blower's circumference, where 0° is the theoretical starting angle of the volute. The axial constraints are shown at 0°-90°, 90°-180°, 180°-270° and 270°-360°. The axial dimension of the impeller is constant. The line labeled "Prior Art" in FIG. 3 shows the largest possible volute having an axial dimension that increases linearly with increasing angle. As demonstrated in FIG. 3, in certain packages, the linearly increasing axial dimension produces an unnecessarily small, and therefore inefficient, cross-sectional area.

The invention provides considerable flexibility in satisfying the requirement that the volute accumulate (accommodate) the tangential velocity, and that the tangential velocity be proportional (to a first approximation) to 1/radius. These requirements are achieved without adhering to the constraint of a linearly increasing axial dimension. The invention achieves cross-sectional area that is relatively larger for any given package constraint, by satisfying the relationships G(Θ) and H(Θ) described above.

In order to use all the space available, a radially constrained volute which directs a fraction of the airflow into a radius smaller than the impeller results in a more efficient housing at high flow rates. The space axially below the impeller at a radius smaller than the impeller can be used to accumulate a significant fraction of the flow rate.

A preferred feature of the invention is the use of a blower characterized in that: a) the maximum radial extent of the inside surface of the volute is significantly smaller than (less than about 90% of) the maximum impeller radial dimension; and b) the axial extent of the housing is significantly greater than (at least twice) the impeller's axial dimension over some position of the blower's circumference.

Figure 5:
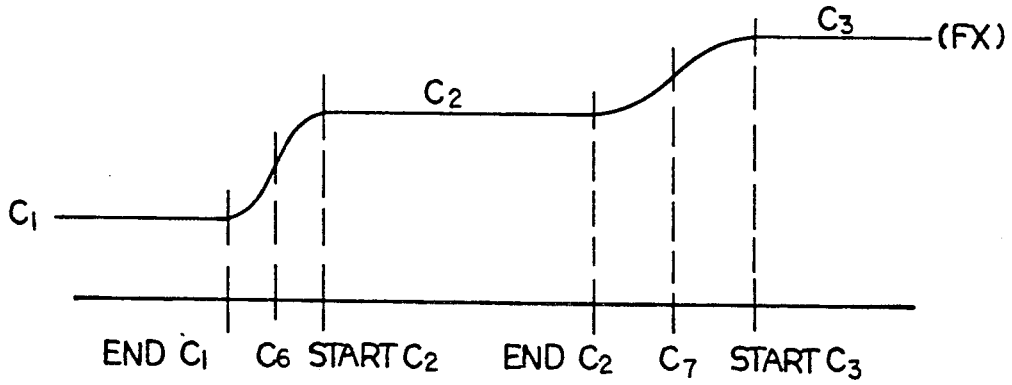
FIG. 5 is a graph of double Fermi or step function.
Figure 4A:
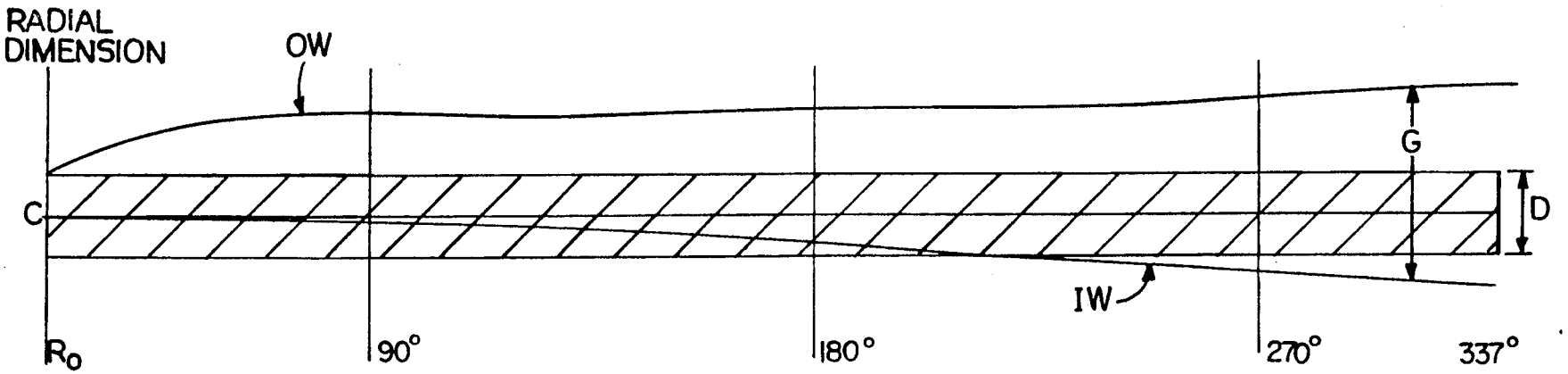
FIG. 4A is a graph of G(Θ).
Figure 4B:
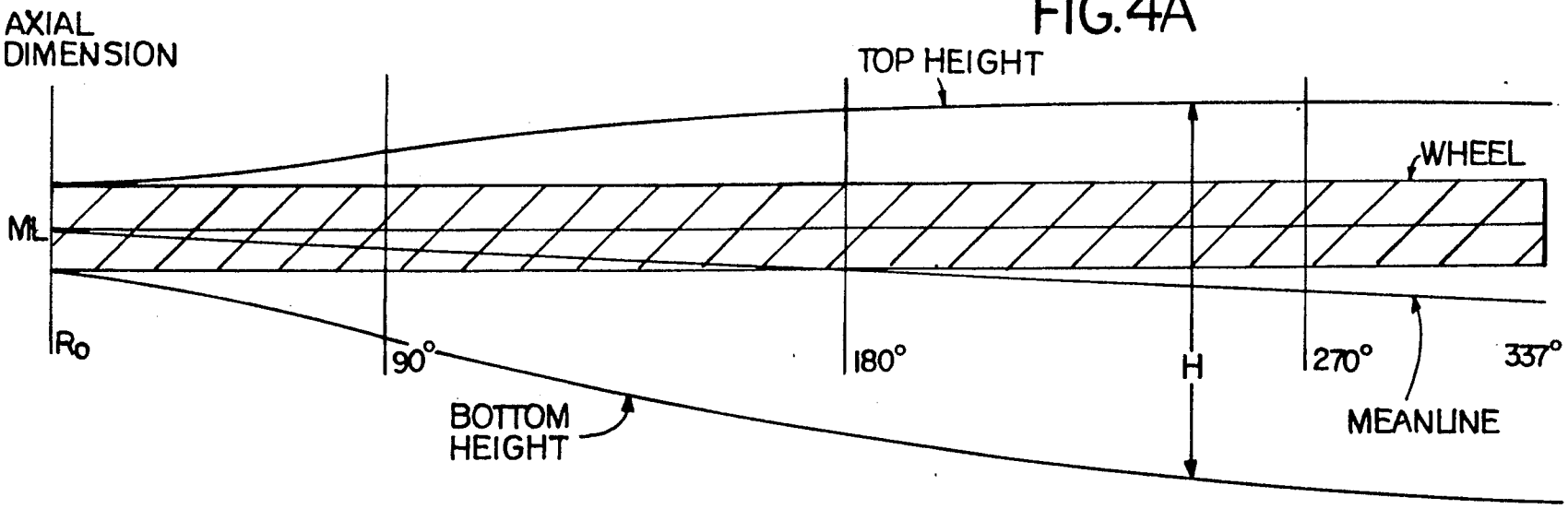
FIG. 4B is a graph of H(Θ).

The above described relationships G(Θ) and H(Θ) can be satisfied even where there are abrupt variations in the radial dimension of the volute, by designing corresponding opposite variations in the axial dimension, thereby limiting the rate of change in the cross-sectional area of the volute. The only limit on the design is the abruptness of the discontinuity that can be tolerated without suffering flow separation The above features are illustrated in FIGS. 4A, 4B and 5, which generally correspond to the blower and volute illustrated in FIG. 1. FIG. 4A shows G(Θ). FIG. 4B shows H(Θ). Approaching the terminus of each constraint, H increases abruptly, and G has a corresponding (slight) decrease.

These features are particularly useful in a volute which radially is constrained and has a radial dimension of the inside surface substantially smaller (less than 90%) of the impeller radius, for a substantial (greater than 45°) of the volute's circumference. In such a volute, a significant fraction of the flow rate can be accumulated in a space axially above or below the impeller at a radius smaller than the impeller.

FIG. 5 illustrates the various coefficients used to develop two overlapping fermi functions to describe blower dimensions (e.g. the axial dimension of the blower) to accommodate three axial constraints $C_1$, $C_2$ and $C_3$, corresponding to coefficients $C_1$, $C_2$ and $C_3$, respectively. In FIG. 5, coefficient $C_4$ defines the rate of transition from $C_1$ to $C_2$, and coefficient $C_5$ defines the rate of transition from $C_2$ to $C_3$. $C_6$ and $C_7$ are the respective transition midpoints. The function is as follows:

$$F(X)=C1+(C2-C1)/[1+e^{-C4\cdot(X-C6)}]+(C3-C2)/[1+e^{-C5\cdot(X-C7)}]$$

Other embodiments are within the following claims.

I claim:

1. A centrifugal blower comprising a rotatable impeller and a volute positioned circumferentially around at least a portion of the impeller to receive airflow from the impeller and direct it to a volute exit, the blower being designed to produce a preestablished airflow from said volute exit, a) said volute being characterized by an axial dimension H which changes as a function of Θ, the angular displacement from the volute exit, and said volute being characterized by a radial dimension G which changes as a function of Θ;

b) at least one of the function G(Θ) and H(Θ) being characterized by an abrupt discontinuity, and the functions G(Θ) and H(Θ) being related as follows:

$$G(\Theta)=g_o(\Theta^{h\cdot tan\alpha\cdot/H(\Theta)}-1),$$

where $g_o$ is a constant;

h is the axial dimension of the volute at the volute origin; and

α is the average angle of airflow exiting the impeller; and c) the volute having a cross-sectional area which maintains a substantially constant pressure field around the impeller at said pre-established airflow.

2. The blower of claim 1 in which said volute comprises a subvolute region axially offset from said impeller and characterized an inner radius which is less than the outer radius of said impeller.

3. The blower of claim 2 in which said subvolute region extends over at least 30° of the circumference of said blower.

4. The blower of claim 2 in which the subvolute region extends from 90° to the volute exit.

5. The blower of claim 4 in which the inner radius of the volute is less than 90% of the impeller outer radius over an arc of at least 45°.

6. The blower of claim 4 in which the axial extent of the volute is at least twice the axial extent of the impeller over said subvolute region.

7. The blower of claim 1 in which H(Θ) is selected from the group consisting of a Fermi function and a superposition of several Fermi functions.

8. The blower of claim 1 in which the discontinuity is characterized by a change in the first derivative of said function of at least 5% over an angular change of 30° or less.

9. The blower of claim 1 in which said volute comprises a subvolute axially offset from said impeller and characterized by an inner radius which is less than the outer radius of said impeller.

10. The blower of claim 9 in which said subvolute region extends over at least 30° of the circumference of said blower.

11. The blower of claim 9 in which said subvolute region extends from 90° to the subvolute exit.

12. The blower of claim 11 in which the inner radius of the volute is less than 90% of the impeller outer radius over an arc of at least 45°.

13. The blower of claim 11 in which the axial extent of the volute is at least twice the axial extent of the impeller over said subvolute region.

* * * * *